US011053742B1

(12) United States Patent
Huynh et al.

(10) Patent No.: US 11,053,742 B1
(45) Date of Patent: Jul. 6, 2021

(54) CUTTER RETENTION FOR ROTATABLE CUTTER

(71) Applicant: Halliburton Energy Services, Inc., Houston, TX (US)

(72) Inventors: Trung Quoc Huynh, Houston, TX (US); Van Jordan Brackin, Spring, TX (US); Kelley Leigh Plunkett, The Woodlands, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 15 days.

(21) Appl. No.: 16/798,035

(22) Filed: Feb. 21, 2020

(51) Int. Cl.
*E21B 10/573* (2006.01)
*E21B 10/42* (2006.01)

(52) U.S. Cl.
CPC ..... *E21B 10/5735* (2013.01); *E21B 10/42* (2013.01)

(58) Field of Classification Search
CPC ..... E21B 10/567; E21B 10/42; E21B 10/573; E21B 10/5735; E21B 10/627; B23P 15/28
See application file for complete search history.

(56) References Cited

U.S. PATENT DOCUMENTS 4,553,615 A * 11/1985 Grainger ..... E21B 10/12 175/432
7,762,359 B1 * 7/2010 Miess ..... E21B 10/633 175/432
9,187,962 B2 * 11/2015 Burhan ..... E21B 10/573
9,464,486 B2 * 10/2016 Zhang ..... E21B 10/36
9,605,486 B2 3/2017 Burhan et al.
10,151,149 B2 * 12/2018 Propes ..... E21B 10/50
10,253,571 B2 * 4/2019 Propes ..... E21B 10/62
10,487,590 B2 * 11/2019 Schroder ..... E21B 10/573
10,724,304 B2 * 7/2020 Bomidi ..... E21B 10/602
10,774,594 B2 * 9/2020 Zhang ..... E21B 10/567
2003/0111273 A1 6/2003 Richert et al.
2006/0033379 A1 * 2/2006 Frear ..... E21C 35/197 299/107
2006/0048976 A1 3/2006 Deguchi et al.
2006/0162967 A1 7/2006 Brackin et al.
2007/0024104 A1 * 2/2007 Monyak ..... E21C 35/197 299/107
2008/0142271 A1 4/2008 Brackin et al.
2008/0202821 A1 8/2008 McClain et al.
2009/0205870 A1 * 8/2009 Smith ..... E21B 10/60 175/57

(Continued)

OTHER PUBLICATIONS

Smith Onyx 360 Cutters (Competitor Product).
Schlumberger, EnduroBlade 360 Rolling Diamond Element bit, 2019.

*Primary Examiner* — Daniel P Stephenson
(74) *Attorney, Agent, or Firm* — Thomas Rooney; C. Tumey Law Group PLLC

(57) ABSTRACT

A rotating cutter for a fixed cutter type bit includes an annular sleeve with a retainer having a plurality of inwardly extending tabs and a spindle cutter rotatably coupled to the annular sleeve. The spindle cutter includes a spindle extending into the annular sleeve and rotatable about a central axis of the annular sleeve, a base portion positioned between the retainer and a proximal end of the annular sleeve, and a cutter portion coupled to the spindle. The rotating cutter further includes at least one pin disposed between adjacent tabs of the plurality of tabs of the retainer to prevent axial movement of the base portion through the retainer.

20 Claims, 9 Drawing Sheets

(56) References Cited

U.S. PATENT DOCUMENTS

| | | | | |
|---|---|---|---|---|
| 2009/0217597 | A1 | 9/2009 | Brackin et al. | |
| 2010/0012387 | A1 | 1/2010 | Huynh et al. | |
| 2010/0163307 | A1 | 7/2010 | Schwefe et al. | |
| 2010/0219001 | A1* | 9/2010 | Shen | E21B 10/52 175/432 |
| 2010/0252327 | A1 | 10/2010 | Beuershausen et al. | |
| 2010/0270077 | A1 | 10/2010 | Huynh et al. | |
| 2010/0314176 | A1* | 12/2010 | Zhang | E21B 10/567 175/383 |
| 2011/0031031 | A1* | 2/2011 | Vempati | B24D 18/0009 175/428 |
| 2012/0273281 | A1* | 11/2012 | Burhan | E21B 10/573 175/431 |
| 2013/0105230 | A1 | 5/2013 | Brackin et al. | |
| 2014/0151132 | A1 | 6/2014 | Brackin et al. | |
| 2014/0339882 | A1* | 11/2014 | Hall | E21C 35/197 299/106 |
| 2014/0360792 | A1* | 12/2014 | Azar | E21B 10/5735 175/432 |
| 2015/0047910 | A1* | 2/2015 | Chen | E21B 10/62 175/336 |
| 2016/0290056 | A1* | 10/2016 | Propes | E21B 10/573 |
| 2018/0355672 | A1* | 12/2018 | De Maindreville | B23C 3/16 |
| 2020/0181986 | A1* | 6/2020 | Schroder | E21B 10/42 |

* cited by examiner

CUTTER RETENTION FOR ROTATABLE CUTTER

BACKGROUND

Various types of tools can be used to form wellbores in subterranean formations for recovering hydrocarbons such as oil and gas lying beneath the surface. Examples of such tools include rotary drill bits, hole openers, reamers, and coring bits. One common type of rotary drill bit used to drill wellbores is known as a fixed-cutter drill bit. Generally, fixed-cutter drill bits may include polycrystalline diamond compact (PDC) cutters each having a polycrystalline diamond (PCD) table on a tungsten carbide substrate, with the base of the substrate fixed within cutter pockets to leading faces of the fix-cutter drill bit.

In conventional wellbore drilling, a fixed-cutter drill bit may be mounted on the end of a drill string, which may be several miles long. At the surface of the wellbore, a rotary table or top drive may turn the drill string, including the drill bit arranged at the bottom of the hole to penetrate the subterranean formation. As the fixed-cutter drill bit rotates, the PDC cutters may shear the subterranean formation.

However, the PDC cutters can experience wear due to interactions with the subterranean formation. Unfortunately, cutting faces of the PDC cutters generally wear unevenly due to varying drilling conditions across the respective cutting faces of the PDC cutters, which can lead to premature failure of the PDC cutters. Some fixed-cutter drill bits incorporate rotating cutting elements to generate more even wear across the cutting faces of the PDC cutters. However, PDC cutters may generally operate in extreme downhole conditions (e.g., heat, pressure, and debris). These extreme downhole conditions may cause some rotating cutting elements to bind or otherwise fail, which may hinder rotation of the rotating cutting element and result in uneven wear and premature failure of the PDC cutters. Such failure may hinder the efficiency of drilling operations.

BRIEF DESCRIPTION OF THE DRAWINGS

These drawings illustrate certain aspects of some examples of the present disclosure and should not be used to limit or define the disclosure.

DETAILED DESCRIPTION

Provided are systems and methods for wellbore drilling and, more particularly, example embodiments may include a retention system for a rotating cutter secured to a fixed cutter drill bit and configured to rotate about an axis of the rotating cutter during drilling operations to reduce wear on at least a portion of a cutting face of the rotating cutter.

Figure 1:
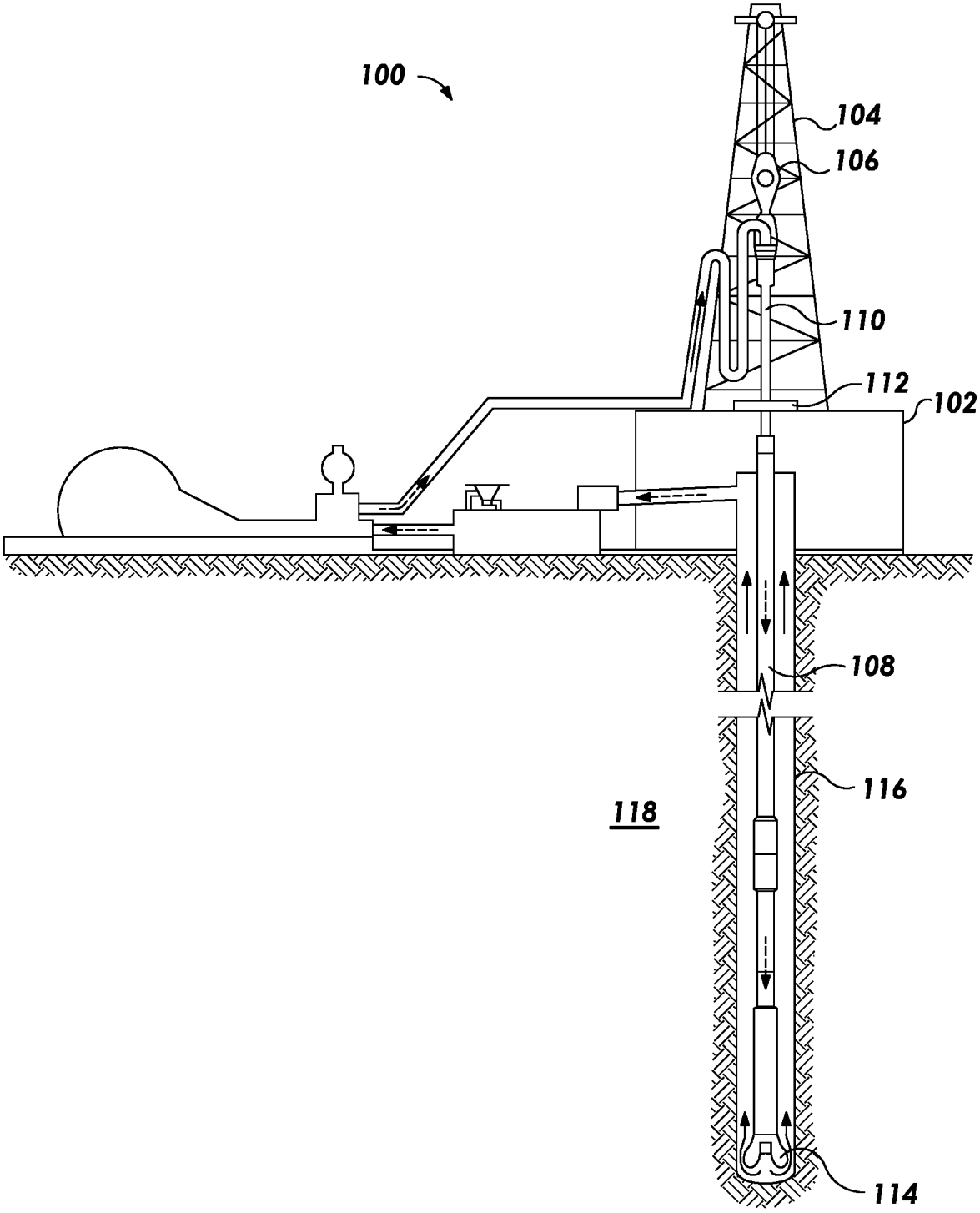
FIG. 1 illustrates a side elevation, partial cross-sectional view of an operational environment for a drilling system in accordance with one or more embodiments of the disclosure.

FIG. 1 illustrates a side elevation, partial cross-sectional view of an operational environment for a drilling system in accordance with one or more embodiments of the disclosure. It should be noted that while FIG. 1 generally depicts a land-based drilling assembly, those skilled in the art will readily recognize that the principles described herein are equally applicable to subsea drilling operations that employ floating or sea-based platforms and rigs, without departing from the scope of the disclosure. As illustrated, the drilling assembly 100 may include a drilling platform 102 that supports a derrick 104 having a traveling block 106 for raising and lowering a drill string 108. The drill string 108 may include, but is not limited to, drill pipe, as generally known to those skilled in the art. A kelly 110 may lowered through a rotary table 112 and can be used to transmit rotary motion from the rotary table to the drill string 108. A drill bit 114 may be attached to the distal end of the drill string 108 and can be driven by a downhole motor and/or via rotation of the drill string 108. As the drill bit 114 rotates, it penetrates various subterranean formations 118 to create a wellbore 116. The drill bit 114 may be of a generally fixed-cutter type configuration, having a plurality of cutters at fixed locations on the bit body, but with one or more being rolling cutters as further detailed below.

Figure 2:
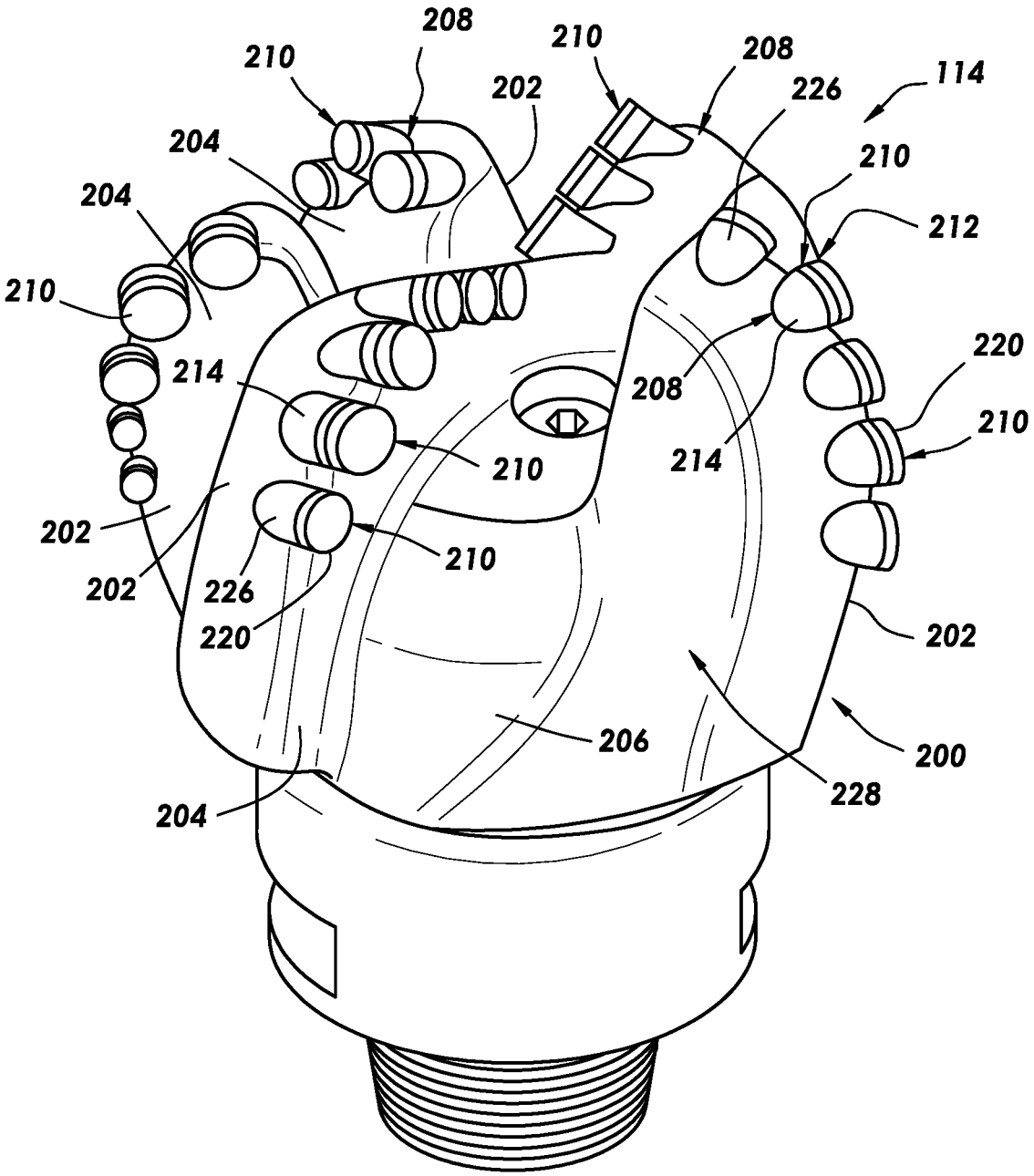
FIG. 2 illustrates a perspective view of an embodiment of the fixed-cutter drill bit that may employ the principles of the present disclosure.
Figure 4:
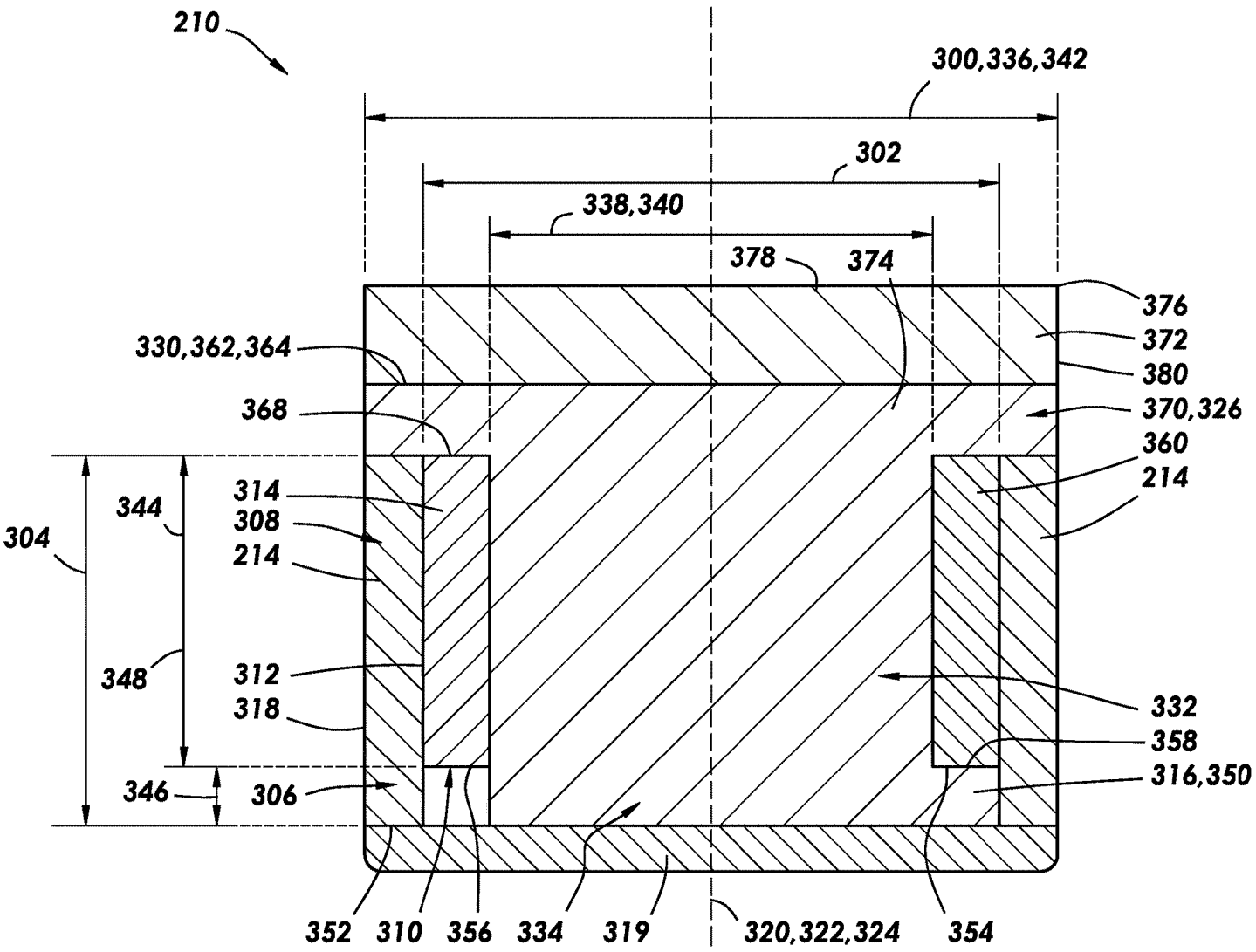
FIG. 4 illustrates a cross-sectional view of the rotating cutter that may be used with the fixed-cutter drill bit of FIG. 2 in accordance with one or more embodiments of the disclosure.

FIG. 2 is a perspective view of an example of a fixed-cutter drill bit 114 having a plurality of cutters secured at fixed locations about a bit body 200. The cutters on this particular example drill bit 114 in FIG. 2 include both fixed cutters 226, which are immovable (or at least non-rotatable) with respect to the bit body 200, and one or more other, rotating cutters 210. While all of the cutters, including fixed cutters 226 and rotating cutters 210, move with the bit 114 and engage the formation 118 to be cut as the bit 114 rotates during drilling, each rotating cutter 210 is additionally free to rotate about its own central axis 420 (as shown in FIG. 4), such as to engage different portions of a 360-degree cutting edge 220 with the formation 118. As discussed in more detail below, each rotating cutter 210 and its ability to roll about its own axis is implemented by way of a spindle cutter 212 that rotates within an annular sleeve 214 secured to the drill bit 114. Although the drill bit 114 in this example includes both a plurality of conventional fixed cutters 226 and a plurality of rotating cutters 210 having the spindle cutters 212 and the annular sleeves 214, a drill bit 114 within the scope of this disclosure may include any number of rotating cutters 210, with as few as one of the cutters being a rotating cutter 210 in one embodiment or as many as all of the cutters being rotating cutters 210 in another embodiment.

Moreover, as illustrated, the bit body 200 of the fixed-cutter drill bit 114 includes radially and longitudinally extending blades 202 having leading faces 204. The bit body, including the blades 202, may be made of a steel or metal-matrix composite of a harder material (e.g., tungsten carbide reinforcing particles dispersed in a binder alloy). As illustrated, the blades 202 are spaced apart from each other on the exterior of the bit body 200 to form fluid flow paths (e.g., junk slots 206) between adjacent blades 202. The field cutters 226 and the rotating cutters 210 (e.g., the annular sleeves 214 of the rotating cutters 210) are secured to the blades 202 of the drill bit 114. The rotating cutters 210 are secured within corresponding cutter pockets 208 formed in an exterior surface 228 of the bit body 200 and shaped or otherwise configured to receive the rotating cutters 210 as described herein. In the illustrated embodiment, the rotating cutters 210 are secured at least partially within their corresponding pocket 208 via brazing. Alternatively, the rotating cutters 210 may be secured at least partially within their corresponding pockets 208 via threading, shrink-fitting, press-fitting, or any combination thereof.

The rotating cutters 210 may be secured within the corresponding pockets 208 at predetermined angular orientations to position the rotating cutters 210 at desired angles with respect to the subterranean formation 118 (e.g., as shown in FIG. 1) being penetrated. As the drill bit 114 is rotated, the rotating cutters 210 are driven through the subterranean formation 118 by the combined forces of the weight-on-bit and the torque experienced at drill bit 114 to shear the various subterranean formations 118. During drilling, the rotating cutters 210 may experience various forces, such as drag forces, axial forces, reactive moment forces, or the like, due to the interaction with the underlying formation 118 being drilled as drill bit 102 rotates. The various forces may drive each rotating cutter 210 to rotate about its own central axis 420, which may reduce wear on a portion of the rotating cutters 210.

Figure 3:
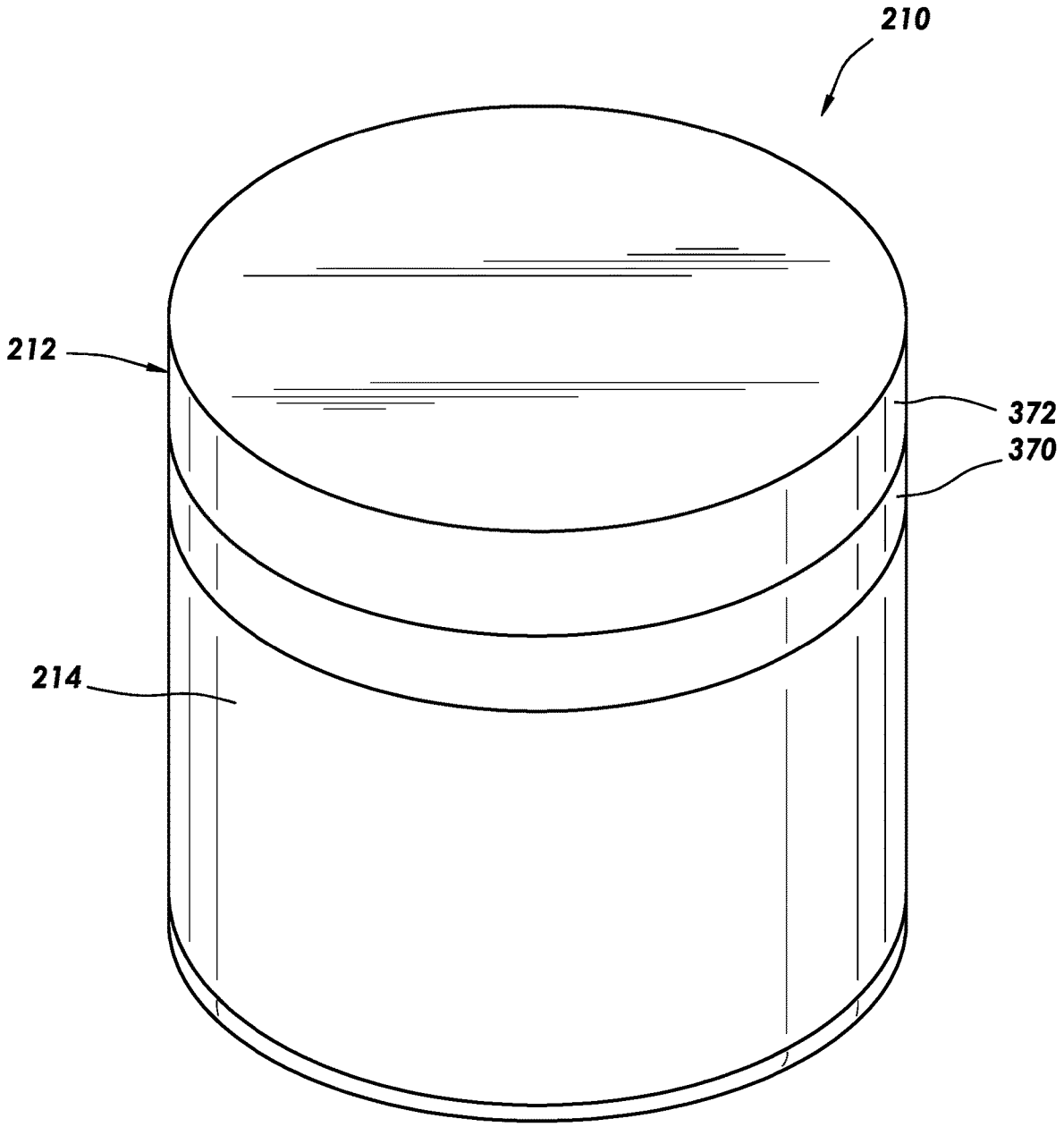
FIG. 3 illustrates a perspective view of an embodiment of a rotating cutter that may be used with the fixed-cutter drill bit of FIG. 2 in accordance with one or more embodiments of the disclosure.

FIG. 3 illustrates a perspective view of an embodiment of a rotating cutter 210 that may be used with the fixed-cutter drill bit 114 of FIG. 2. As set forth above, the rotating cutter 210 includes the annular sleeve 214, which is secured to the drill bit. The rotating cutter 210 also includes the spindle cutter 212 positioned within the annular sleeve 214. In the illustrated embodiment, the spindle cutter 212 is rotatably coupled within the annular sleeve 214. That is, the spindle cutter 212 is free to rotate within the annular sleeve 214, but is restrained from moving axially with respect to the annular sleeve 214, such that at least a portion of the spindle cutter 212 is retained within the annular sleeve 214. Further, the spindle cutter 212 includes a cutter portion 372 coupled to a substrate 370 (e.g., a spindle 328 of the spindle cutter 212). The cutter portion 372 is driven through the subterranean formation to shear the various subterranean formations.

FIG. 4 illustrates a cross-sectional view of the rotating cutter 210 of FIG. 3 in accordance with some embodiments of the disclosure. While rotating cutter 210 is shown with respect to fixed-cutter drill bit 114, it will be appreciated that rotating cutters 210, as discussed herein, are not limited to use with a fixed-cutter drill bit 114 and may be utilized on any downhole tool. As illustrated, each rotating cutter 210 may include a substrate 370 made of an extremely hard material (e.g., tungsten carbide) and a cutter portion 372 secured to the substrate 370. A distal portion 326 of a spindle 328 of the spindle cutter 212 may be used as the substrate 370 for the cutter portion 372. The cutter portion 372 includes one or more layers of an ultra-hard material, such as polycrystalline diamond, polycrystalline cubic boron nitride, impregnated diamond, etc., which generally forms a cutting edge 376 and a working face 378 for each cutter portion 372. The working face 378 is typically flat or planar but may also exhibit a curved exposed surface that meets a side surface 380 at the cutting edge 376.

To form the cutter portion 372, the substrate 370 (e.g., distal portion 326 of the spindle 328) may be placed adjacent a layer of ultra-hard material particles, such as diamond or cubic boron nitride particles, and the combination is subjected to high temperature at a pressure where the ultra-hard material particles are thermodynamically stable. This results in recrystallization and formation of a polycrystalline ultra-hard material layer, such as a polycrystalline diamond or polycrystalline cubic boron nitride layer, directly onto the upper surface of the substrate 370. For manufacturing purposes, the distal portion 326 of the spindle 328 may be separate from a central portion 332 of the spindle 328 during formation of the cutter portion 372. The distal portion 326 of the spindle 328 (e.g., the substrate 370) may be brazed or otherwise coupled to the spindle 328 after formation of the cutter portion 372. To further decrease exposure of the substrate 370 and the formed cutter portion 372 to high temperatures, such as those present in brazing techniques, the distal portion 326 of the spindle 328 may be brazed or otherwise coupled to the central portion 332 of the spindle 328 before formation of the cutter portion 372. Further, the distal portion 326 of the spindle 328 and the central portion 332 of the spindle 328 may include a unibody construction. Moreover, the cutter portion 372 is formed on the substrate 370 (e.g., distal portion 326 of the spindle 328) while the spindle cutter 212 is separate from the annular sleeve 214.

Moreover, as illustrated, the rotating cutter 210 includes the annular sleeve 214. In the illustrated embodiment, the annular sleeve 214 has a uniform outer diameter 300 along an axial length of the annular sleeve 214. The annular sleeve 214 may also have a uniform inner diameter 302 along the axial length 304 of the annular sleeve. However, the annular sleeve 214 may include at least one chamfered portion such that a proximal portion 306 of the annular sleeve 214 and/or a distal portion 308 of the annular sleeve have varying inner diameters 302 and/or outer diameters 300.

A retainer 310 is coupled to an inner surface 312 of the annular sleeve 214. The retainer 310 includes a plurality of tabs 314 extending radially inward from the inner surface 312 of the annular sleeve 214. Alternatively, the annular sleeve 214 may include the retainer 310. That is, the annular sleeve 214 may be machined to include a plurality of tabs 314 (e.g., protrusions) extending radially inward from the uniform inner diameter 302 of the annular sleeve 214. As set forth in greater detail below, the plurality of tabs 314 of the retainer 310 may only permit the spindle cutter 212 to pass through the retainer 310 in a single orientation.

With additional reference to FIG. 2, an exterior surface 318 of the annular sleeve is be secured (e.g., brazed) to a corresponding pocket of the plurality of pockets 208 formed in the bit body 200 of the fixed-cutter drill bit 114 (as best shown in FIG. 2). The annular sleeve 214 is secured to the corresponding pocket 208 such that the annular sleeve 214 is stationary with respect to the corresponding pocket 208 during drilling operations. Further, the rotating cutter 210 includes a cap 319 coupled to the proximal end 352 of the annular sleeve 214. At least a portion of the cap 319 may be secured within the corresponding pocket 208 via brazing, threading, shrink-fitting, press-fitting, snap rings, or any combination thereof.

The rotating cutter 210 also includes the spindle cutter 212. The spindle cutter 212 is rotatably coupled to the annular sleeve 214. That is, the spindle cutter 212 is restrained from moving axially with respect to the annular sleeve 214 while remaining free to rotate about the central axis 320 of the rotating cutter 210. The spindle cutter 212 and the annular sleeve 214 are coaxial while rotatably coupled such that a central axis 322 of the spindle cutter 212 and a central axis 324 of the annular sleeve are coaxial with the central axis 320 of the rotating cutter 210. The spindle cutter 212 may rotate clockwise, counterclockwise, or some combination thereof, based at least in part on the various forces acting on the spindle cutter 212 during drilling operations. As set forth above, the various forces acting on the spindle cutter 212 are generated by interactions of the spindle cutter 212 with the underlying formation 118 (e.g., shown on FIG. 1) being drilled as drill bit 102 rotates. The cutter portion 372 and/or the substrate 370 (e.g., distal portion 326 of a spindle 328) may interact with the underlying formation 118 to generate the various forces during drilling operations.

The spindle cutter 212 includes the spindle 328, the base portion 316, and the cutter portion 372 coupled (e.g., sintered) to a distal end 330 of the spindle 328. Each of the spindle 328, the base portion 316, and the cutter portion 372 are configured to rotate about the central axis 320 of the rotating cutter 210 during drilling operations. As illustrated, the spindle 328 has a cylindrical form that extends along the central axis 320 of the rotating cutter 210. The spindle 328 has the distal portion 326 (e.g., the substrate 370), a central portion 332, and a proximal portion 334. A diameter 336 of the distal portion 326 is greater than both a diameter 338 of the central portion 332 and a diameter 340 of the proximal portion 334. Alternatively, the diameter 336 of the distal portion 326 may be substantially equal to an outer diameter 300 of the annular sleeve 214 such that the rotating cutter 210 has a uniform outer diameter 342 along the central axis 320 of the rotating cutter 210.

In the illustrated embodiment, the proximal portion 334 and the central portion 332 of the spindle 328 have a similar diameter. Further, a diameter 338 of the central portion 332 and a diameter 340 of the proximal portion 334 are uniform along an axial length 344 of the central portion 332 and an axial length 346 of the proximal portion 334, respectively. Moreover, the central portion 332 is positioned within the annular sleeve 214. At least a portion of the central portion 332 is positioned radially interior to the plurality of tabs 314 of the retainer 310 and extends along an axial length 348 of the plurality of tabs 314. In the illustrated embodiment, the central portion 332 and the proximal portion 334 do not include a circumferential slot or groove in respective external surfaces of the central portion and the proximal portion. Generally, a circumferential body may include a circumferential slot or groove to house a retaining ring or snap ring for holding the circumferential body in bore. However, embodiments of the present disclosure do not include a retaining ring or snap ring for holding the spindle cutter 212 in the annular sleeve 214. Including a circumferential slot or groove would merely increase manufacturing complexity and may hinder rotation of spindle cutter.

The base portion 316 of the spindle cutter 212 includes a plurality of protrusions 350 extending radially outward from the proximal portion 334 of the spindle 328. For installation purposes, the plurality of protrusions 350 are configured to pass through the retainer 310 in a single orientation. Once the spindle cutter 212 is installed, the base portion 316 is positioned between the retainer 310 and a proximal end 352 of the annular sleeve 214. The plurality of protrusions 350 holds the spindle cutter 212 in the annular sleeve 214 during drilling operations. That is, contact between a distal end 354 of the base portion 316 and a proximal end 356 of the retainer 310 holds the spindle cutter 212 in the annular sleeve 214. Further, as set forth below, contact between the distal end 354 of the base portion 316 and the proximal end 358 of at least one pin 360 holds the spindle cutter 212 in the annular sleeve 214.

The spindle cutter 212 also includes the cutter portion 372 coupled (e.g., sintered) to the distal end 330 of the spindle 328. An interface end 362 of the cutter is coupled to a distal end 364 of the distal portion 326 of the spindle 328. The cutter portion 372 has a similar diameter to the diameter 336 of the distal portion 326 of the spindle 328 (e.g., the substrate 370). Further, the cutter portion 372 is configured to rotate about the central axis 320 of the rotating cutter 210 with the distal portion 326 of the spindle, the central portion 332 of the spindle, and the proximal portion 334 of the spindle. Although the cutter portion 372 includes a super hard material (e.g., polycrystalline diamond), the cutter portion 372 may wear due to interactions with the underlying formation 118 (e.g., shown in FIG. 1) as the drill bit rotates. Rotating the cutter portion 372 about the central axis 320 of the rotating cutter 210, as discussed herein, may extend the life span of the cutter portion 372. Generally, fixed cutters have increased wear on a particular portion of the cutter from being positioned in a high wear area. Rotating the cutter portion 372 rotates each portion of the cutter portion 372 into the high wear area for at least a portion of the drilling operation, which may cause the cutter portion 372 to wear more evenly. Wearing the cutter portion 372 more evenly may delay having a portion of the cutter fail due to wear, as the particular portion of the cutter portion 372 may not fail prematurely with respect to other portions of the cutter portion 372.

Moreover, the rotating cutter 210 also includes the pin 360 press-fit between adjacent tabs 314 of the plurality of tabs of the retainer 310 to hold the spindle cutter 212 in the annular sleeve. As set forth in greater detail below, the plurality of tabs 314 are positioned around the inner surface 312 of the annular sleeve 214 such that the retainer 310 only permits the spindle cutter 212 (e.g., a base portion 316 of the spindle cutter 212) to pass through the retainer 310 in a single orientation. However, during drilling operations, it is undesirable for the base portion 316 to move axially by passing through the retainer 310 in any orientation. Thus, the pin 360 is press-fit between adjacent tabs 314 of the plurality of tabs of the retainer 310 to contact the spindle cutter 212 in the single orientation to hold the spindle cutter 212 in the annular sleeve 214. That is, the pin 360 prevents axial movement of the base portion 316 through the retainer 310.

Figure 5:
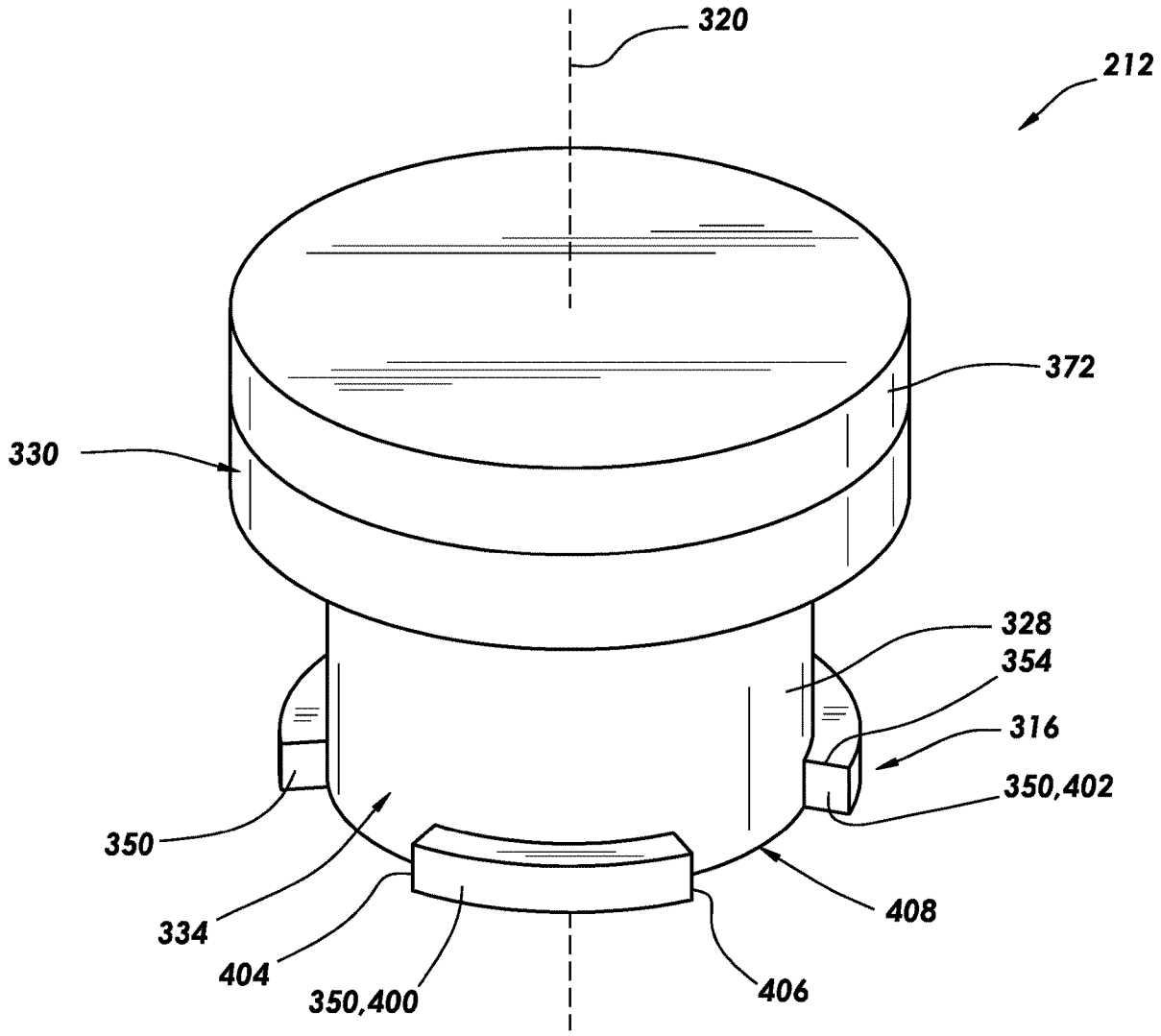
FIG. 5 illustrates a side view of a spindle cutter assembly of the rotating cutter of FIG. 3 in accordance with one or more embodiments of the disclosure.

FIG. 5 illustrates an isometric view of the spindle cutter 212 that may be used with the rotating cutter 210 of FIG. 3 in accordance with some embodiments of the disclosure. As set forth above, the spindle cutter 212 includes the spindle 328, the base portion 316, and the cutter portion 372 coupled (e.g., sintered) to a distal end 330 of the spindle 328. Each of the spindle 328, the base portion 316, and the cutter portion 372 are configured to rotate about the central axis 320 of the rotating cutter 210 (e.g., shown in FIG. 4) during drilling operations. The base portion 316 of the spindle cutter 212 includes the plurality of protrusions 350 extending radially outward from the proximal portion 334 of the spindle 328. In the illustrated embodiment, three protrusions of the plurality of protrusions 350 are shown extending radially outward from opposing sides of the proximal portion 334 of the spindle 328. The three protrusions extend radially outward from the proximal portion 334 of the spindle 328 at equally spaced intervals (e.g., at 0°, 120°, and 240° with respect to the spindle 328). However, the plurality of protrusions 350 may be spaced at unequal intervals (e.g., at 100°, 170°, 280°, and 350° with respect to the spindle 328). Alternatively, the plurality of protrusions 350 may include any number of protrusions.

Each protrusion of the plurality of protrusions 350 may include a unique shape configured to fit through a corresponding portion of the retainer 310, such that the base portion 316 may pass through the retainer 310 in a single orientation. As such, each protrusion 350 may have a unique cross section. For example, a first protrusion 400 may extend radially outward from the spindle 328 along 0° to 5° of the spindle 328, and a second protrusion 402 may extend radially outward from the spindle 328 along 120° to 130° of the spindle 328 such that the second protrusion 402 has a larger cross section than the first protrusion 400. In an alternative embodiment, the plurality of protrusions 350 may extend outward from the spindle 328 in directions offset from the radial direction. For example, a first edge 404 of the first protrusion 400 may extend outward from 0° of the spindle 328 in a first direction (e.g., offset from the radial direction by 10°), and a right edge 406 of the first protrusion 400 may extend outward from 5° of the spindle 328 in a second direction (e.g., offset from the radial direction by −10°), such that a taper of the cross-section of the first protrusion 400 is inverted. In an alternative embodiment, the plurality of protrusions 350 have non-linear edges extending outward from the spindle 328.

In the illustrated embodiment, each protrusion of the plurality of protrusions 350 has a uniform cross-section along the central axis 320 of the rotating cutter 210. Alternatively, each protrusion of the plurality of protrusions 350 may have a non-uniform cross-section along the central axis 320 of the rotating cutter 210. The non-uniform cross-section along the central axis 320 of the rotating cutter 210 may include a taper narrowing towards a proximal end 408 of the spindle 328, a taper narrowing towards a distal end 354 of the base portion 316, or some combination thereof. The plurality of protrusions 350 extend along the proximal portion 334 of the spindle 328 a length equal to or less than a distance between a proximal end 356 of the retainer 310 and a proximal end 352 of the annular sleeve 214 (e.g., shown in FIG. 4). During drilling operations, the base portion 316 is positioned between the retainer 310 and the proximal end 352 of the annular sleeve 214 (e.g., shown in FIG. 4).

Figure 6:
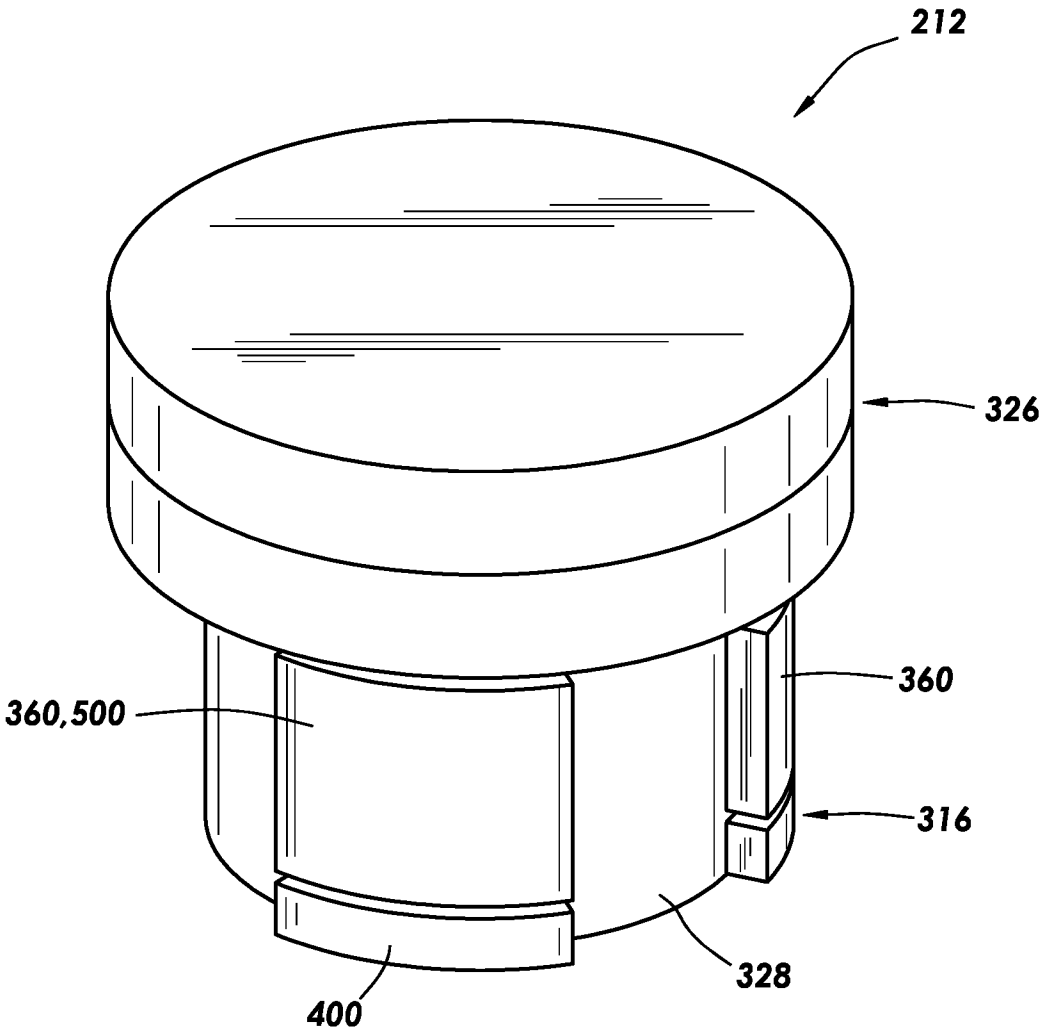
FIG. 6 illustrates a side view of another embodiment of at least one pin attached to the spindle cutter assembly of the rotating cutter of FIG. 3 in accordance with one or more embodiments of the disclosure.

FIG. 6 illustrates a side view of another embodiment of the pin 360 attached to the spindle cutter 212 that may be used with the rotating cutter 210 of FIG. 3 in accordance with some embodiments of the disclosure. As set forth above, the pin 360 is press-fit between adjacent tabs of the plurality of tabs 314 of the retainer 310 (shown in FIG. 4) to prevent axial movement of the base portion 316 of the spindle cutter 212 through the retainer 310 during drilling operations. Prior to insertion of the spindle cutter 212 into the annular sleeve 214 of FIG. 3, the pin 360 is bonded to the spindle cutter 212. An adhesive (e.g., cyanoacrylate, epoxy, and polyurethane) is used to bond the pin 360 to the spindle cutter 212. They may be any adhesive configured to provide sufficient bonding for installing the spindle cutter 212 into the annular sleeve 214. The adhesive provides a bond configured to break after installation such that the pin 360 detaches from the spindle cutter 212 after installation. Alternatively, the bond may be configured to break from torque on the spindle cutter 212 during drilling operations.

In the illustrated embodiment, the pin 360 is coupled to a portion of the spindle cutter 212 between the base portion 316 and the distal portion 326 of the spindle cutter 212. Further, the pin 360 is bonded to the spindle cutter 212 between a protrusion of the plurality of protrusions 350 and the distal portion 326 of the spindle 328. For example, a first pin 500 is bonded to the spindle cutter 212 between a first protrusion 400 and the distal portion 326 of the spindle 328.

Figure 7B:
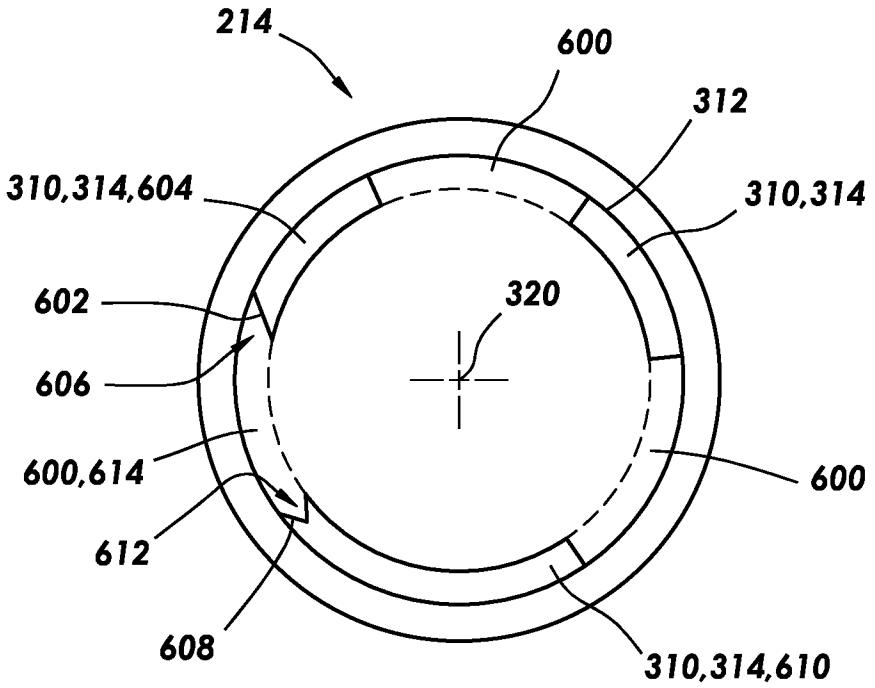
FIGS. 7A and 7B illustrate a three-dimensional perspective view and exemplary top view, respectively, of the retainer and the annular sleeve of the rotating cutter of FIG. 3 in accordance with one or more embodiments of the disclosure.
Figure 7A:
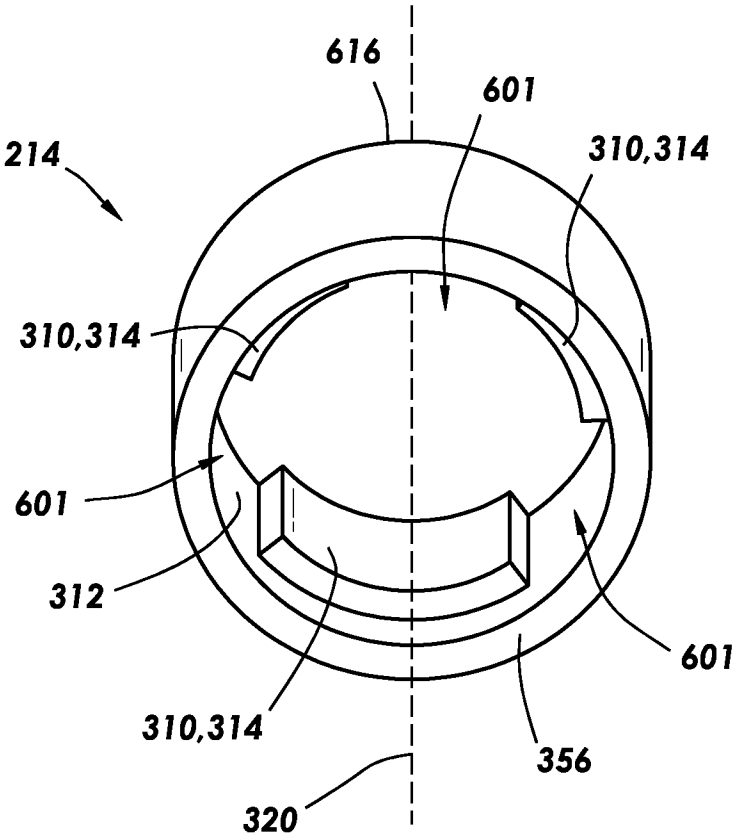

FIG. 7A illustrates a three-dimensional perspective view of the retainer 310 and the annular sleeve 214 that may be used with the rotating cutter 210 of FIG. 3. As set forth above, the retainer 310 includes the plurality of tabs 314 extending radially inward from the inner surface 312 of the annular sleeve 214. In the illustrated embodiment, the plurality of tabs 314 includes three tabs extending radially inward from the inner surface 312 of the annular sleeve 214. The three tabs extend radially inward from the inner surface 312 of the annular sleeve 214 at equally spaced intervals (e.g., at 60°, 180°, and 300° with respect to the central axis 320 of the rotating cutter 210). Alternatively, the plurality of tabs 314 may be spaced at unequal intervals (e.g., at 35°, 145°, 115°, and 225° with respect to the central axis 320 of the rotating cutter 210). In an alternative embodiment, the plurality of tabs 314 may include any number of tabs.

Moreover, in the illustrated embodiment, each tab of the plurality of tabs 314 has a uniform cross-section along the central axis 320 of the rotating cutter 210. Alternatively, each tab of the plurality of tabs 314 may have a non-uniform cross-section along the central axis 320 of the rotating cutter 210. Further, each tab of the plurality of tabs 314 may include a tapered form along the central axis 320 of the rotating cutter 210. The tapered form may include a taper narrowing towards the proximal end 356 of the retainer 310, a taper narrowing towards a distal end 616 of the retainer 310, or some combination thereof.

FIG. 7B illustrates a top view of the retainer 310 and the annular sleeve 214 that may be used with the rotating cutter 210 of FIG. 3. The retainer 310 includes the plurality of tabs 314 positioned around the inner surface 312 of the annular sleeve 214 to form slots 600 between adjacent tabs of the plurality of tabs 314. The plurality of tabs 314 may be positioned around the inner surface 312 of the annular sleeve 214, shaped, and/or sized to form at least one unique slot 614 between adjacent tabs of the plurality of tabs 314. Further, a protrusion 350 corresponding to the unique slot 614 may include a unique shape configured to fit through the corresponding unique slot 614. As only the corresponding protrusion 350 with the unique shape may pass through the unique slot 614, having the unique slot 614 may permit the spindle cutter 212 (e.g., a base portion 316 of the spindle cutter 212) to pass through the retainer 310 in only a single orientation. In an alternative embodiment having a plurality of unique slots 614, each protrusion of the plurality of protrusions 350 (as best shown in FIG. 4) may include a respective unique shape configured to fit through corresponding unique slots positioned between adjacent tabs 314 of the plurality of tabs such that the base portion 316 of the spindle cutter 212 may pass through the retainer 310 in a single orientation.

In the illustrated embodiment, a first tab 604 and a second tab 610 of the plurality of tabs 314 each include unique shapes that, in conjunction, form the unique slot 614 in a space between the adjacent first tab 604 and second tab 610. As illustrated, a first edge 602 of the first tab 604 extends in a non-radial direction to form a unique taper on a first side 606 of the unique slot 614. Further, a second edge 608 of the second tab 610 is non-linear to form a non-linear edge for the second side 612 of the unique slot 614. As the first side 606 and the second side 612 of the unique slot 614 are vary with respect to other sides of the other slots 600, the unique slot 614 has a unique shape. In an alternative embodiment, any suitable variations to the tabs 314 and/or the annular sleeve 214 may be included to form the unique slot 614.

Figure 8:
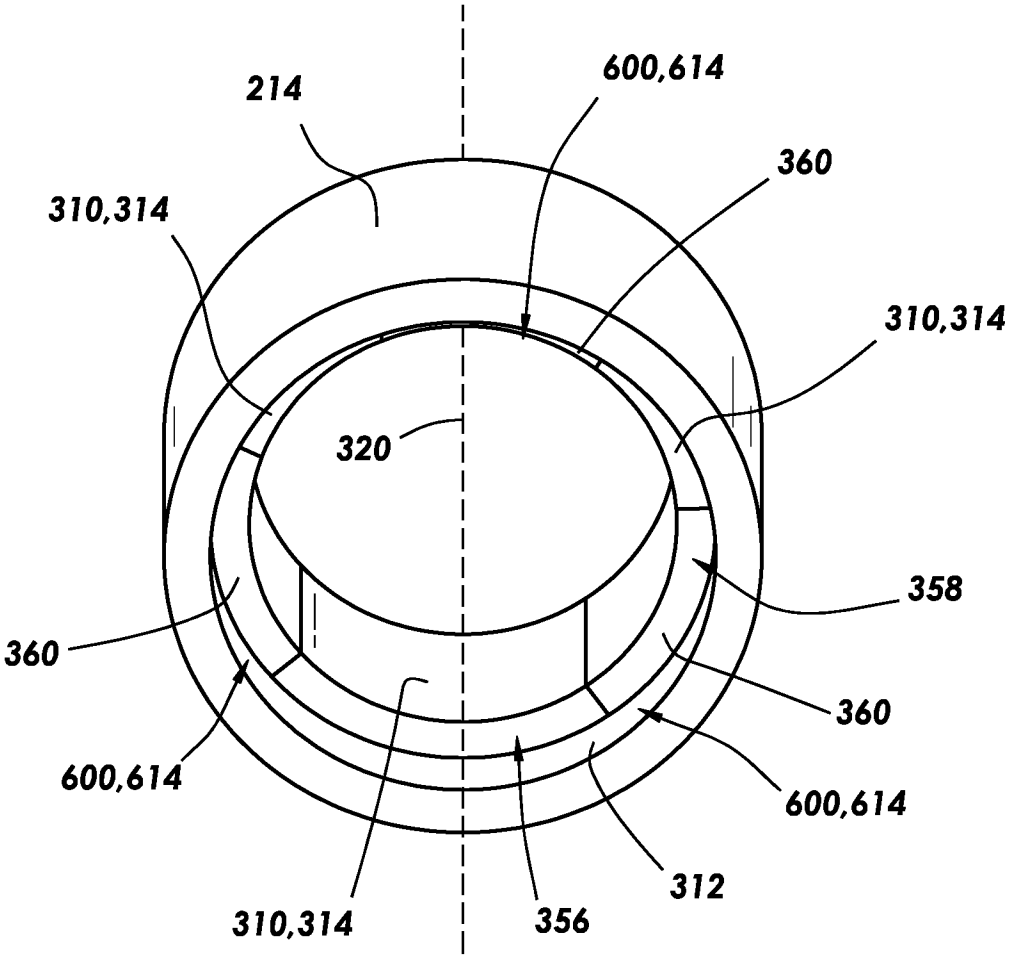
FIG. 8 illustrates a three-dimensional perspective view of the at least one pin disposed within slots formed between adjacent tabs of the retainer, and that may be used with the rotating cutter of FIG. 3 in accordance with one or more embodiments of the disclosure.

FIG. 8 illustrates a three-dimensional perspective view of the pin 360 positioned within the slots 600 or the unique slot 614 (as best shown in FIGS. 7A and 7B) formed between adjacent tabs 314 of the retainer 310, and that may be used with the rotating cutter 210 of FIG. 3. As set forth above, the pin 360 is press-fit between adjacent tabs of the plurality of tabs 314 of the retainer 310 to prevent axial movement of the base portion 316 of the spindle cutter 212 (as best shown in FIG. 3) through the retainer 310 during drilling operations. That is, the pin 360 is press-fit between adjacent tabs 314 of the plurality of tabs of the retainer 310 to hold the spindle cutter 212 in the annular sleeve 214. As set forth above, the plurality of tabs 314 may be positioned around the inner surface 312 of the annular sleeve 214 to form the slots 600 or the unique slot 614 (as best shown in FIGS. 7A and 7B) between adjacent tabs 314 to the plurality of tabs. As set forth above, having the unique slot 614 permits the spindle cutter 212 (e.g., a base portion 316 of the spindle cutter 212) to pass through the retainer 310 in only a single orientation.

During drilling operations, it is undesirable for the base portion 316 to move axially (e.g., pass through the retainer 310). Although, the unique slot 614 only permits the spindle cutter 212 to pass through the retainer 310 in a single orientation, without the pin 360, the spindle cutter 212 may still pass through the retainer 310 during drilling operations. Thus, the pin 360 is press-fit between adjacent tabs 314 of the plurality of tabs of the retainer 310 to hold the spindle cutter 212 in the annular sleeve 214 when the spindle cutter 212 is oriented in the single orientation. In the illustrated embodiment, the pin 360 includes a pin 360 for each slot 600 formed between adjacent tabs 314 of the plurality of tabs 314. Each pin 360 may include a unique shape for its corresponding slot 600 and/or unique slot 614. The shape of each pin 360 may be larger than the shape of its corresponding slot 600 and/or unique slot 614 such that the pin 360 may be press-fit into its corresponding slot 600. Each pin of the at least one pin 360 may be positioned on the spindle cutter 212 based on respective positions of the corresponding slot 600 or unique slot 614.

In the illustrated embodiment, the pin 360 is press fit into the slot 600 such that a proximal end 358 of the pin 360 is axially aligned with a proximal end 356 of the retainer 310. Aligning the proximal ends 358, 356 of the pin 360 and the retainer 310 creates a substantially smooth surface. As set forth above, the base portion 316 is positioned between retainer 310 and the proximal end 352 of the annular sleeve 214 (as best shown in FIG. 3) and rotates about the central axis 320 of the rotating cutter 210 (as best shown in FIG. 3). Having a substantially smooth surface may reduce a risk that the plurality of protrusions 350 of FIG. 3 catch on the retainer 310 or the pin 360.

The annular sleeve 214 and the retainer 310 include a steel carbide material. Alternatively, the annular sleeve 214 and the retainer 310 may include any suitable material having a hardness greater than the steel carbide material. Moreover, the pin 360 may include a steel material, an aluminum-bronze material, or any other suitable material. The pin 360 is press-fit into the slot 600 or unique slot 614 positioned between adjacent tabs of the plurality of tabs 314 of the retainer 310. Thus, the material of the pin 360 may be any suitable material having a hardness less than a material of the retainer 310. For example, the plurality of tabs 314 of the retainer 310 may include a tungsten carbide material having a hardness greater than eighty HRA. In this example, the pin 360 may include a material having a hardness less than sixty HRC, such a stainless steel.

Figure 9:
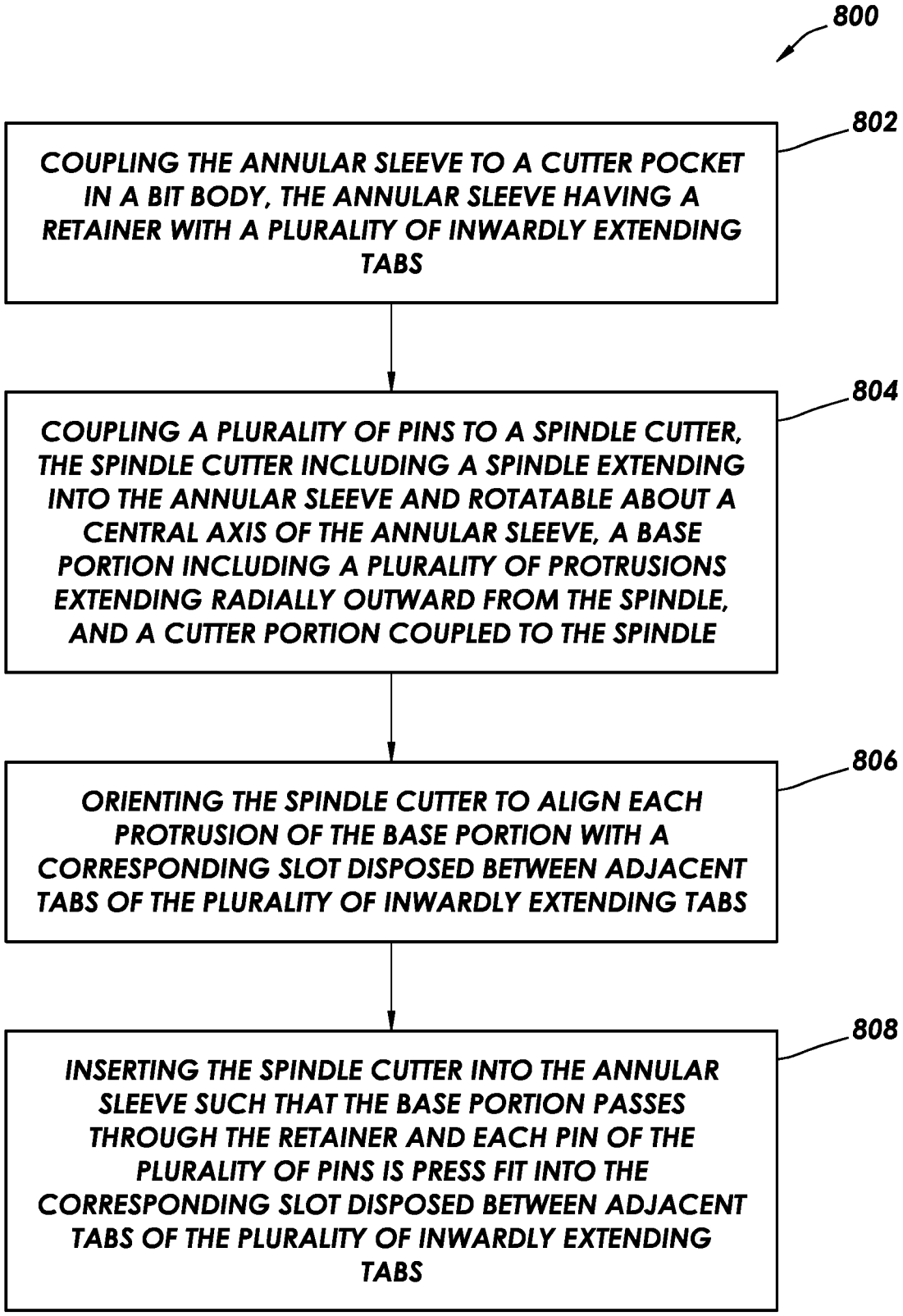
FIG. 9 illustrates a flow chart of a method for assembling and installing the rotating cutter that may be used with the fixed-cutter drill bit of FIG. 2 in accordance with one or more embodiments of the disclosure.

FIG. 9 illustrates a flow chart 800 of a method for assembling and installing the rotating cutter 210 that may be used with the fixed-cutter drill bit 114 of FIG. 2 in accordance with some embodiments of the disclosure. The method includes the step (block 802) of coupling (e.g., brazing) the annular sleeve 214 to the cutter pocket 208 in the bit body 200, the annular sleeve 214 having the retainer 310 with the inwardly extending tabs 314. The method further includes the step (block 804) of coupling the plurality of pins 360 to the spindle cutter 212. As set forth above, the spindle cutter 212 includes the spindle 328 extending into the annular sleeve 214 and rotatable about the central axis 320 of the annular sleeve 214, the base portion 316 including the protrusions 350 extending radially outward from the spindle 328, and the cutter portion 372 coupled to the spindle 328, and wherein each pin of the plurality of pins 360 is coupled to the spindle cutter 212 at a position between the cutter portion 372 and the corresponding protrusion 350 of the base portion 316. The pin 360 may be coupled to the spindle cutter 212 via an adhesive configured to bond the pin 360 to the spindle cutter 212 during installation of the spindle cutter 212. The method also includes the step (block 806) of orienting the spindle cutter 212 to align each protrusion of the base portion 316 with the corresponding slot 600 or the corresponding unique slot 614 disposed between adjacent tabs of the plurality of inwardly extending tabs 314. Additionally, the method includes the step (block 808) of inserting the spindle cutter 212 into the annular sleeve 214 such that the base portion 316 passes through the retainer 310 and each pin of the pin 360 is press fit into a corresponding slot 600 or corresponding unique slot 614 disposed between adjacent tabs of the plurality of tabs 314. Each pin of the pin 360 may include a suitable shape and material for forming a press-fit in the corresponding slot 600 or corresponding unique slot 614 between the adjacent tabs 314. During insertion of the spindle cutter 212, a proximal end of the distal portion 326 of the spindle cutter 212 may be configured to apply pressure to the distal end of the pin 360 to force the pin 360 into the corresponding slot 600 or the corresponding unique slot 614; thereby, press-fitting the pin 360 between the adjacent tabs 314 of the retainer 310.

The method may include the step of disconnecting the pin 360 from the spindle cutter 212 by rotating the spindle cutter 212 with respect to the annular sleeve 214. Alternatively, the pin 360 may disconnect from the spindle cutter 212 during insertion of the spindle cutter 212 into the annular sleeve 214. Further, in other embodiments, torque acting on the spindle cutter 212 during drilling operations may be sufficient to disconnect the pin 360 from the spindle cutter 212 such that the spindle cutter 212 may rotate about the central axis 320 of the rotating cutter 210.

Accordingly, the preceding description provides a retention system for a rotating cutter secured to a fixed cutter drill bit and configured to rotate about an axis of the rotating cutter during drilling operations to reduce wear on at least a portion of a cutting face of the rotating cutter. The systems, methods, and apparatus may include any of the various features disclosed herein, including one or more of the following statements.

Statement 1. A rotating cutter for a fixed cutter type bit may comprising an annular sleeve including a retainer with a plurality of inwardly extending tabs; a spindle cutter rotatably coupled to the annular sleeve, the spindle cutter including a spindle extending into the annular sleeve and rotatable about a central axis of the annular sleeve, a base portion positioned between the retainer and a proximal end of the annular sleeve, and a cutter portion coupled to the spindle; and at least one pin disposed between adjacent tabs of the plurality of tabs of the retainer, wherein the at least one pin prevents axial movement of the base portion through the retainer.

Statement 2. The rotating cutter of statement 1, wherein the base portion of the spindle cutter includes a plurality of protrusions extending radially outward from the spindle that interact with the at least one pin and the plurality of tabs on the retainer to prevent axial movement of the base portion through the retainer.

Statement 3. The rotating cutter of any proceeding statement, wherein at least one protrusion of the plurality of protrusions has a unique shape to fit through a corresponding slot disposed between adjacent tabs of the plurality of tabs.

Statement 4. The rotating cutter of any proceeding statement, wherein the cutter portion is coupled to a distal end of the spindle, and the plurality of protrusions extend radially outward from a proximal portion of the spindle.

Statement 5. The rotating cutter of any proceeding statement, wherein the annular sleeve has a uniform inner diameter along an axial length of the annular sleeve.

Statement 6. The rotating cutter of any proceeding statement, wherein a first diameter of the proximal portion of the spindle is less than a second diameter of a distal portion of the spindle.

Statement 7. The rotating cutter of any proceeding statement, wherein a diameter of a distal portion of the spindle is substantially equal to an outer diameter of the annular sleeve.

Statement 8. The rotating cutter of any proceeding statement, wherein the proximal portion of the spindle includes a uniform diameter along an axial length of the annular sleeve.

Statement 9. The rotating cutter of any proceeding statement, wherein each tab of the plurality of tabs includes a tapered form along an axial length of the annular sleeve.

Statement 10. The rotating cutter of any proceeding statement, wherein each tab of the plurality of tabs includes a uniform cross-section along a longitudinal direction of the annular sleeve.

Statement 11. A drill bit may comprise a bit body; a blade extending from the bit body, wherein the blade includes at least one cutter pocket; an annular sleeve secured within the at least one cutter pocket, the annular sleeve having a retainer with a plurality of inwardly extending tabs positioned within the annular sleeve; a spindle cutter rotatably coupled to the annular sleeve, the spindle cutter including a spindle extending into the annular sleeve and rotatable about a central axis of the annular sleeve, a base portion positioned between the retainer and a proximal end of the annular sleeve, and a cutter portion coupled to the spindle; and at least one pin disposed between adjacent tabs of the plurality of tabs of the retainer, wherein the at least one pin prevents axial movement of the base portion through the retainer.

Statement 12. The drill bit of statement 11, wherein the base portion of the spindle cutter includes a plurality of protrusions extending radially outward from the spindle that interact with the at least one pin and the plurality of tabs on the retainer to prevent axial movement of the base portion through the retainer.

Statement 13. The drill bit of statement 11 or statement 12, wherein each protrusion of the plurality of protrusions has a unique shape to fit through a corresponding slot disposed between adjacent tabs of the plurality of tabs.

Statement 14. The drill bit of statements 11-13, wherein the cutter portion includes a polycrystalline diamond material, and wherein the annular sleeve and the retainer each include a carbide steel material.

Statement 15. The drill bit of any of statements 11-14, wherein the at least one pin includes a steel material.

Statement 16. The drill bit of any of statements 11-15, wherein the at least one pin includes a material with a hardness of less than sixty HRC.

Statement 17. A method may comprise coupling an annular sleeve to a cutter pocket in a bit body, the annular sleeve having a retainer with a plurality of inwardly extending tabs; coupling a plurality of pins to a spindle cutter, the spindle cutter including a spindle extending into the annular sleeve and rotatable about a central axis of the annular sleeve, a base portion including a plurality of protrusions extending radially outward from the spindle, and a cutter portion coupled to the spindle, and wherein each pin of the plurality of pins is coupled to the spindle cutter at a position between the cutter portion and a corresponding protrusion of the base portion; orienting the spindle cutter to align each protrusion of the base portion with a corresponding slot disposed between adjacent tabs of the plurality of inwardly extending tabs; and inserting the spindle cutter into the annular sleeve such that the base portion passes through the retainer and each pin of the plurality of pins is press fit into the corresponding slot disposed between adjacent tabs of the plurality of inwardly extending tabs.

Statement 18. The method of statement 17, wherein the cutter portion is coupled to a distal end of the spindle, and the plurality of protrusions extend radially outward from a proximal portion of the spindle.

Statement 19. The method of statement 17 or statement 18, further comprising coupling a cap to a proximal end of the annular sleeve.

Statement 20. The method of statements 17-19, further comprising disconnecting the plurality of pins from the spindle cutter by rotating the spindle cutter with respect to the annular sleeve.

It should be understood that, although individual examples may be discussed herein, the present disclosure covers all combinations of the disclosed examples, including, without limitation, the different component combinations, method step combinations, and properties of the system. It should be understood that the compositions and methods are described in terms of "comprising," "containing," or "including" various components or steps, the compositions and methods can also "consist essentially of" or "consist of" the various components and steps. Moreover, the indefinite articles "a" or "an," as used in the claims, are defined herein to mean one or more than one of the elements that it introduces.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present examples are well adapted to attain the ends and advantages mentioned as well as those that are inherent therein. The particular examples disclosed above are illustrative only and may be modified and practiced in different but equivalent manners apparent to those skilled in the art having the benefit of the teachings herein. Although individual examples are discussed, the disclosure covers all combinations of all of the examples. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative examples disclosed above may be altered or modified and all such variations are considered within the scope and spirit of those examples. If there is any conflict in the usages of a word or term in this specification and one or more patent(s) or other documents that may be incorporated herein by reference, the definitions that are consistent with this specification should be adopted.

What is claimed is:

1. A rotating cutter for a fixed cutter type bit, comprising:

an annular sleeve including a retainer with a plurality of inwardly extending tabs;

a spindle cutter rotatably coupled to the annular sleeve, the spindle cutter including a spindle extending into the annular sleeve and rotatable about a central axis of the annular sleeve, a base portion positioned between the retainer and a proximal end of the annular sleeve, and a cutter portion coupled to the spindle; and at least one pin positioned between adjacent tabs of the plurality of tabs of the retainer to prevent axial movement of the base portion through the retainer.

2. The rotating cutter of claim 1, wherein the base portion of the spindle cutter includes a plurality of protrusions extending radially outward from the spindle that interact with the at least one pin and the plurality of tabs on the retainer to prevent axial movement of the base portion through the retainer.

3. The rotating cutter of claim 2, wherein at least one protrusion of the plurality of protrusions has a unique shape to fit through a corresponding slot disposed between adjacent tabs of the plurality of tabs.

4. The rotating cutter of claim 2, wherein the cutter portion is coupled to a distal end of the spindle, and the plurality of protrusions extend radially outward from a proximal portion of the spindle.

5. The rotating cutter of claim 1, wherein the annular sleeve has a uniform inner diameter along an axial length of the annular sleeve.

6. The rotating cutter of claim 1, wherein a first diameter of the proximal portion of the spindle is less than a second diameter of a distal portion of the spindle.

7. The rotating cutter of claim 1, wherein a diameter of a distal portion of the spindle is substantially equal to an outer diameter of the annular sleeve.

8. The rotating cutter of claim 1, wherein the proximal portion of the spindle includes a uniform diameter along an axial length of the annular sleeve.

9. The rotating cutter of claim 1, wherein each tab of the plurality of tabs includes a tapered form along an axial length of the annular sleeve.

10. The rotating cutter of claim 1, wherein each tab of the plurality of tabs includes a uniform cross-section along a longitudinal direction of the annular sleeve.

11. A drill bit, comprising:

a bit body;

a blade extending from the bit body, wherein the blade includes at least one cutter pocket;

an annular sleeve secured within the at least one cutter pocket, the annular sleeve having a retainer with a plurality of inwardly extending tabs positioned within the annular sleeve;

a spindle cutter rotatably coupled to the annular sleeve, the spindle cutter including a spindle extending into the annular sleeve and rotatable about a central axis of the annular sleeve, a base portion positioned between the retainer and a proximal end of the annular sleeve, and a cutter portion coupled to the spindle; and at least one pin disposed between adjacent tabs of the plurality of tabs of the retainer to prevent axial movement of the base portion through the retainer.

12. The drill bit of claim 11, wherein the base portion of the spindle cutter includes a plurality of protrusions extending radially outward from the spindle that interact with the at least one pin and the plurality of tabs on the retainer to prevent axial movement of the base portion through the retainer.

13. The drill bit of claim 12, wherein each protrusion of the plurality of protrusions has a unique shape to fit through a corresponding slot disposed between adjacent tabs of the plurality of tabs.

14. The drill bit of claim 11, wherein the cutter portion includes a polycrystalline diamond material, and wherein the annular sleeve and the retainer each include a carbide steel material.

15. The drill bit of claim 11, wherein the at least one pin includes a steel material.

16. The drill bit of claim 11, wherein the at least one pin includes a material with a hardness of less than sixty HRC.

17. A method, comprising:

coupling an annular sleeve to a cutter pocket in a bit body, the annular sleeve having a retainer with a plurality of inwardly extending tabs;

coupling a plurality of pins to a spindle cutter, the spindle cutter including a spindle extending into the annular sleeve and rotatable about a central axis of the annular sleeve, a base portion including a plurality of protrusions extending radially outward from the spindle, and a cutter portion coupled to the spindle, and wherein each pin of the plurality of pins is coupled to the spindle cutter at a position between the cutter portion and a corresponding protrusion of the base portion;

orienting the spindle cutter to align each protrusion of the base portion with a corresponding slot disposed between adjacent tabs of the plurality of inwardly extending tabs; and inserting the spindle cutter into the annular sleeve such that the base portion passes through the retainer and each pin of the plurality of pins is press fit into the corresponding slot disposed between adjacent tabs of the plurality of inwardly extending tabs.

18. The method of claim 17, wherein the cutter portion is coupled to a distal end of the spindle, and the plurality of protrusions extend radially outward from a proximal portion of the spindle.

19. The method of claim 17, further comprising coupling a cap to a proximal end of the annular sleeve.

20. The method of claim 17, further comprising disconnecting the plurality of pins from the spindle cutter by rotating the spindle cutter with respect to the annular sleeve.

* * * * *